US005690048A

United States Patent [19]

Friesen et al.

[11] Patent Number: 5,690,048

[45] Date of Patent: Nov. 25, 1997

[54] BOAT HULL CONSTRUCTION

[76] Inventors: John Friesen, 827 Pt. Pelee Drive; Jake Friesen, 789 Pt. Pelle Drive, both of Leamington, Ontario, Canada, N8H 3V4; Henry Friesen, 43 Bruce Avenue, Leamington, Ontario, Canada, N8H 4C4

[21] Appl. No.: 636,581

[22] Filed: Apr. 23, 1996

[51] Int. Cl.[6] ..... B63B 3/16; B63B 3/26

[52] U.S. Cl. ..... 114/356; 114/79 W; 114/357; 114/359

[58] Field of Search ..... 114/356, 357, 114/359, 355, 65 R, 79 R, 79 W; 29/897.2

[56] References Cited

U.S. PATENT DOCUMENTS

| | | | |
|---|---|---|---|
| 2,433,745 | 12/1947 | Ditchburn | 114/356 |
| 3,176,055 | 3/1965 | Loos | 114/357 |
| 3,388,446 | 6/1968 | Phillips | 114/356 |
| 3,943,586 | 3/1976 | Palmer | 114/356 |
| 4,739,722 | 4/1988 | Rogstad | 114/356 |
| 4,892,054 | 1/1990 | Davidison | 114/357 |
| 5,063,870 | 11/1991 | Wagner | 114/357 |

*Primary Examiner*—Sherman Basinger
*Attorney, Agent, or Firm*—Howard & Howard

[57] ABSTRACT

A boat hull is constructed of inner and outer aluminum skin layers. A foam material and a plurality of spaced frame members are sandwiched between the two skin layers. The skin layers are directly welded to the spaced frame members, which preferably are spaced apart at close intervals, to ensure structural integrity and product performance. A preferred method of constructing a boat hull designed according to this invention includes providing a temporary support structure that is connected to longitudinal beams of the boat hull frame. After spaced frame members are connected to the longitudinal beams a first skin layer is attached. The temporary support structure is then removed and the aluminum skin layers are attached to the spaced frame members. A liquid, curable, closed cell foam preferably is injected into the spacing between the skin layers and the spaced frame members.

15 Claims, 4 Drawing Sheets

BOAT HULL CONSTRUCTION

BACKGROUND OF THE INVENTION

This invention relates generally to boat hulls and, more specifically, to a boat hull construction including a foam layer between inner and outer aluminum skin layers. This invention also includes a unique method of constructing such a boat hull.

Modern boats are often formed of fiberglass. Fiberglass is typically utilized as it is more easily manufactured into complex curvatures and shapes. This is particularly true in custom racing boats, wherein the shape the boat hull is quite difficult to pre-fabricate, and is not fabricated in large quantities. Fiberglass hulls do have some disadvantages. First, fiberglass does have the tendency to fracture. Moreover, fiberglass does not have as much rigidity as an aluminum hull boat would have. In a high speed racing and pleasure boat, rigidity is very important.

The use of aluminum to form boat hulls is known. Typically, aluminum has required time consuming assembly steps to achieve any complex curvatures or shapes and to obtain smoothness for cosmetics. This is particularly true in custom boat making, wherein the assembler is making a single hull, rather than mass-producing the boat hulls. On the other hand, aluminum does address some of the concerns presented by fiberglass. In particular, aluminum is less subject to fracturing. Even so, the aluminum boat hulls that have been utilized in the past have still had less rigidity than would be desirable.

For the foregoing reasons, it is the object of this invention to disclose a boat hull formed of a metal, and most preferably aluminum, that provides increased rigidity when compared to the prior art. Moreover, it is the object of this invention to propose a method of easily shaping those boat hulls to the desired configuration.

SUMMARY OF THE INVENTION

In general terms, this invention is an aluminum boat hull having a plurality of longitudinal beams and a plurality of spaced frame members attached to and extending between and on the outside of the longitudinal beams. Each of the frame members includes first and second sidewalls and a web portion extending between the side walls. A first aluminum skin layer is attached to the first side wall on the frame members to form an outer skin layer. A second aluminum skin layer is attached to the inner side wall on the aluminum frame members such that the frame members are sandwiched between the first and second aluminum skin layers. A foam material fills the spaces between the skin layers and the spaced frame members.

The inventive structure results in an increased rigidity in the boat hull. The opposed skins with the crossing frame members provide increased rigidity compared to the prior art. Moreover, the foam material enhances the rigidity. The foam material also provides sound insulation characteristics.

In the presently preferred embodiment, the inner and outer aluminum skin layers are welded directly to the frame members using a stitch welding technique. The foam material is preferably a closed cell urethane foam that is injected into the spacing between the skin layers after they have been attached to the frame members.

The skins are preferably welded in sections. Thus, should one section become damaged, only that section need be removed. With the prior art fiber glass hulls, if there is a fracture anywhere on the hull one must often replace the entire hull.

The method of this invention for assembling a shell for use in constructing a boat hull includes several basic steps. First, a plurality of reference support pieces are arranged in a preselected orientation that corresponds to the desired shape of the boat hull. Next, a plurality of longitudinal beams are connected to the reference support pieces. Then, a plurality of spaced frame members are connected to the longitudinal beams. The spaced frame members are preferably spaced apart a distance of six inches. Fourth, an outer aluminum skin layer is attached or welded to an outer portion of the frame members. The reference support pieces then are disconnected from the longitudinal beams and a second aluminum skin layer is attached to an inner portion of the frame members such that the spaced frame members are sandwiched between the first and second skin layers. Lastly, a foam material is injected into the spacing between the first and second skin layers and the frame members.

The inventive method allows the assembler to first position the reference support pieces at locations such that the longitudinal beams may be bent to their desired curvature when attached to the reference support pieces. That is, the reference support pieces place reference points about which the longitudinal beams can be bent to achieve the desired curvature. In this way, the initial set-up, positioning and bending of the longitudinal beams can be quickly and easily attained. This is a great improvement over the prior art. Once the frame members have been attached to the longitudinal beams, and the outer skin has been attached, the support members and longitudinal beams are held in place by the outer skin, and the interconnection. The reference support pieces can then be removed, and yet the remaining hull will have the desired curvature and shape. This inventive method thus greatly reduces the complexity and time required to form a custom made boat as compared to prior art methods.

These and other features and advantages of this invention will become apparent to those skilled in the art from the following detailed description of the presently preferred embodiment. The drawings that accompany the detailed description can be described as follows.

DETAILED DESCRIPTION OF THE PREFERRED EMBODIMENT

Figure 1:
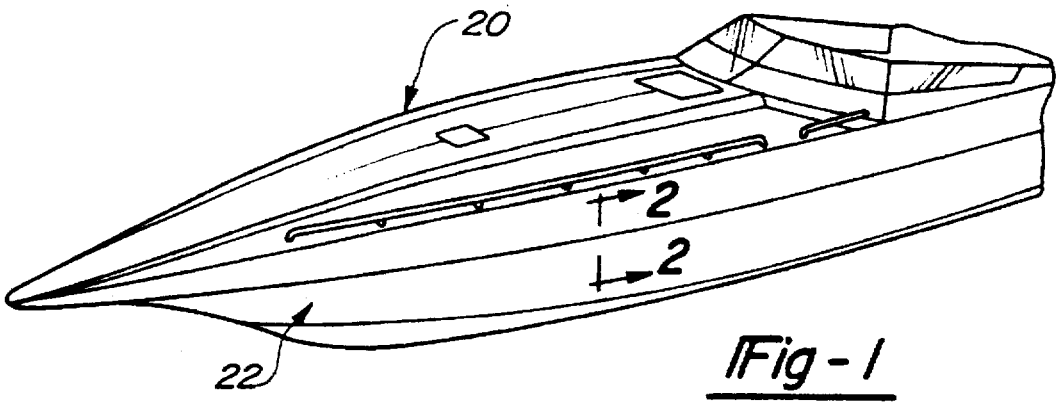
FIG. 1 is a perspective illustration of a boat.
Figure 2:
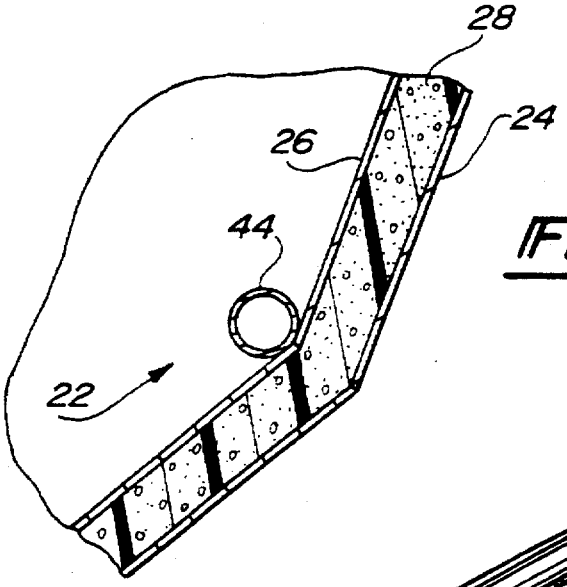
FIG. 2 is a partial cross-sectional view taken along the lines 2—2 of FIG. 1.

FIG. 1 illustrates a boat 20, which includes a boat hull 22 designed according to this invention. The cross-sectional illustration of FIG. 2 shows a selected portion of the boat hull 22. The boat hull 22 includes an outer aluminum skin layer 24 and an inner aluminum skin layer 26. Sandwiched between the two skin layers is a closed cell foam material 28. Further details about the boat hull 22 and the inventive method of manufacturing the boat hull 22 will now be described.

Figure 3:
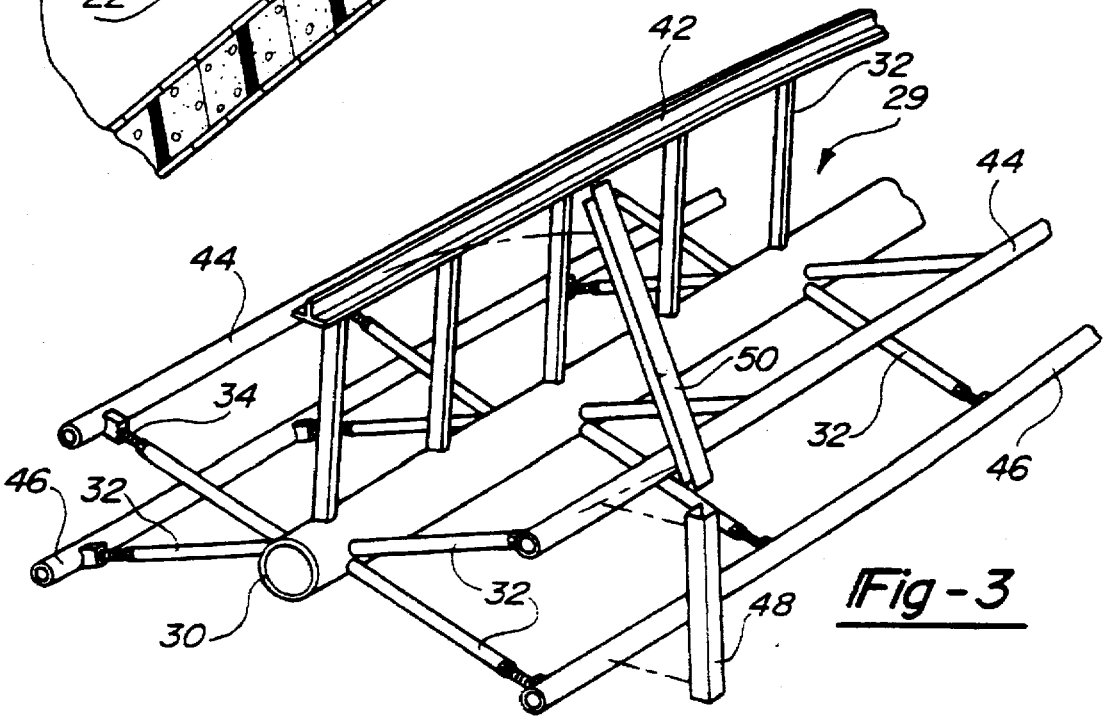
FIG. 3 is a diagrammatic perspective view of a portion of a supporting structure for use in assembling a boat hull according to this invention.

Referring to FIG. 3, a temporary reference, or support structure 29 is illustrated including a central, longitudinal reference support beam 30. A plurality of outwardly extending reference support beams 32 are attached to the central beam 30. The outward ends 34 on the support beams 32, which are most distal from the central beam 30 are oriented to define the shape of the boat hull 22. That is, the length of the support beams 32, in part, defines the curvature of the boat hull.

Figure 5:
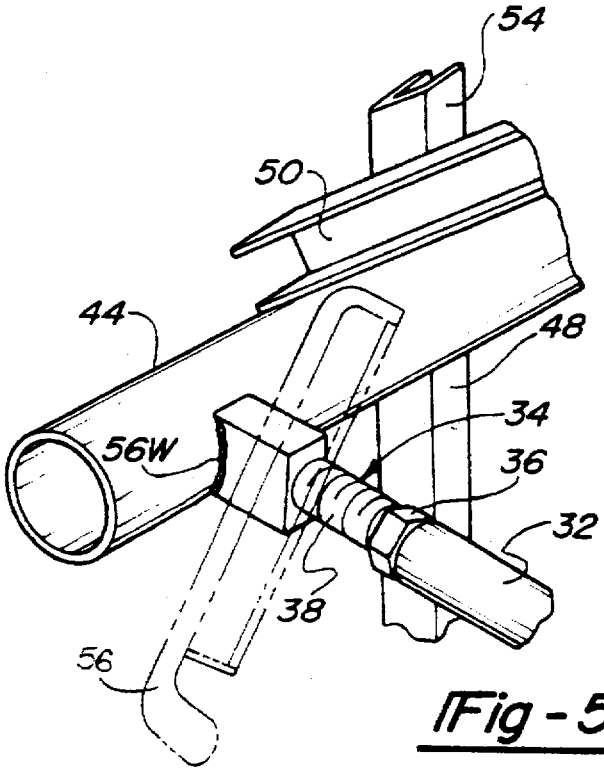
FIG. 5 is a detailed perspective view of the portion of FIG. 4 indicated by the circular line 5 in FIG. 4.

Referring to FIG. 5, the preferred embodiment of the outward end 34 of the support beams 32 is illustrated. The combination of threaded members 36 and 38 preferably are provided in order to adjust the length of the support member 32. An outer-most connection member 40 is at the most outward end of the support beam 32. The shape of member 40 may vary from the illustrated shape.

A plurality of longitudinal boat hull beams are connected to the support pieces 32. In the embodiment illustrated in FIG. 3, for example, a keel beam 42 has a generally T-shaped cross section. Two chine pipes 44 and two rubrail pipes 46 also are provided. The longitudinal beams 42, 44 and 46 preferably are made of an aluminum material. The longitudinal beams are manipulated to correspond to the shape defined by the length and arrangement of the support members 32. As will be appreciated by those skilled in the art, varying the spacing between the longitudinal beams 44 and 46, for example, will also effect the curvature of the eventual boat hull 22. The longitudinal beams 42, 44, and 46 preferably are welded to the connecting portions 40 on the reference support beams 32.

Once the longitudinal beams 42, 44, and 46 are connected to the support beams 32, a plurality of spaced frame members 48 and 50 are connected to the longitudinal beams such that the frame members extend between the longitudinal beams. The illustrated embodiment includes frame members 48 extending between the rubrail beam 46 and the chine beam 44 while frame members 50 extend between the keel beam 42 and the chine beam 44. Further details about the frame members 48 and 50 will be provided below. In the presently preferred embodiment, the frame members are spaced apart along the longitudinal beams with a center to center spacing illustrated at 52 in FIG. 4. Close spacings between the frame members are preferred to enhance structural performance and cosmetic characteristics. In one example, the spacing was six inches.

The frame members 48 and 50 preferably are welded to the longitudinal beams 42, 44, and 46, respectively. In the illustrated embodiment, the frame members 48 have an extending portion 54 when they are connected to the longitudinal beams 46 and 44. The extending portion 54 can be cut off by conventional methods after the frame members 48 are welded in place to the longitudinal beam in order to provide a mitered corner 58. By removing the extending portion 54 after the frame members 48 have been welded in place, the manufacturing process can proceed more quickly. Further, when custom-designing boat hulls, the need for making special-sized frame members 48 can be essentially eliminated.

As mentioned above, the connecting portions 40 are initially positioned at desired locations. The beams 42, 44 and 46 are then positioned to be in contact with the several connecting portions. This then results in the beams 42, 44 and 46 having the desired final shape. The frame members 48 and 50 are then connected to the longitudinal beams 42, 44 and 46. Once the outer skin is attached, the frame members and longitudinal beams are then locked at their desired locations. The reference support structure may then be removed. By utilizing the reference support structure, applicant has invented a way to quickly and accurately position the longitudinal beams and frame members in the desired locations.

Figure 4:
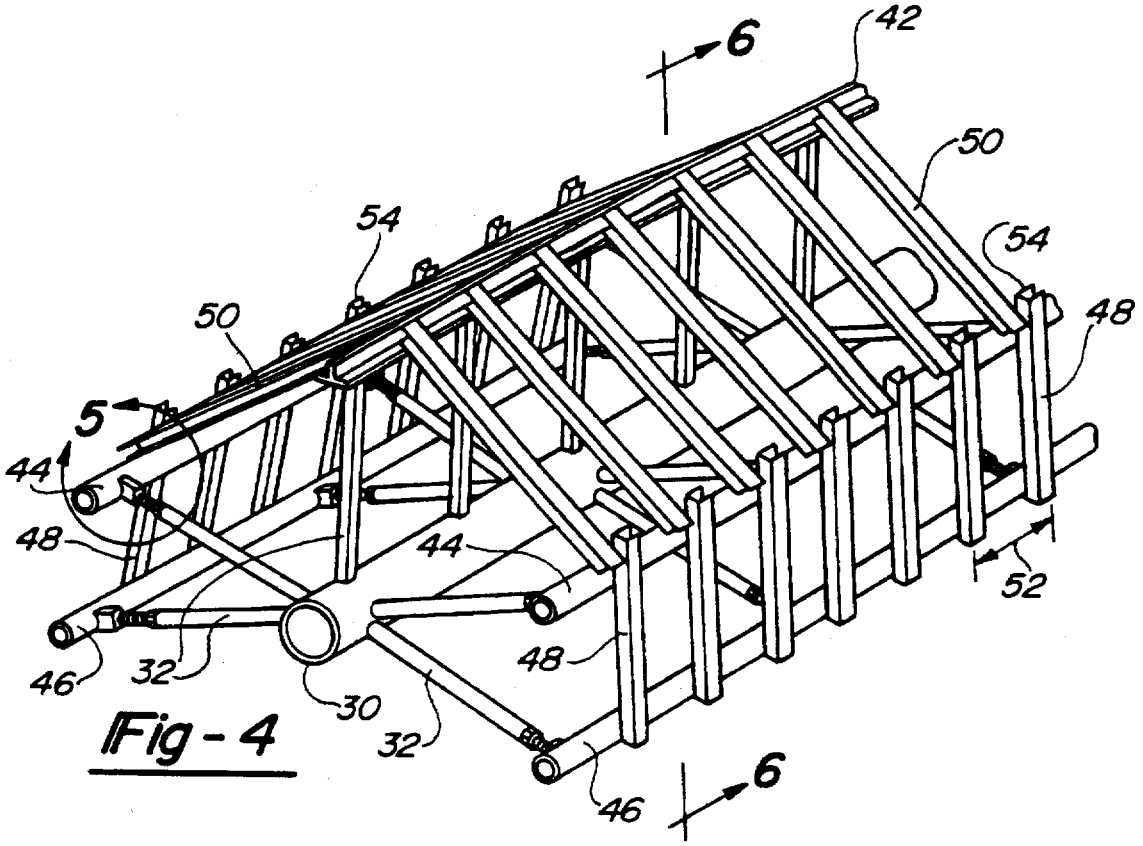
FIG. 4 is a diagrammatic perspective view of a partially completed boat hull designed according to this invention.

It is important to note that the illustration of FIG. 4 does not show a complete boat hull construction. The illustration does, however, show how the assembly of longitudinal beams and frame members defines the shape of a boat hull. Once all of the frame members 50 and 48 are welded in place and any extending portions 54 have been appropriately removed, an aluminum outer skin layer preferably is assembled as follows.

Figure 6:
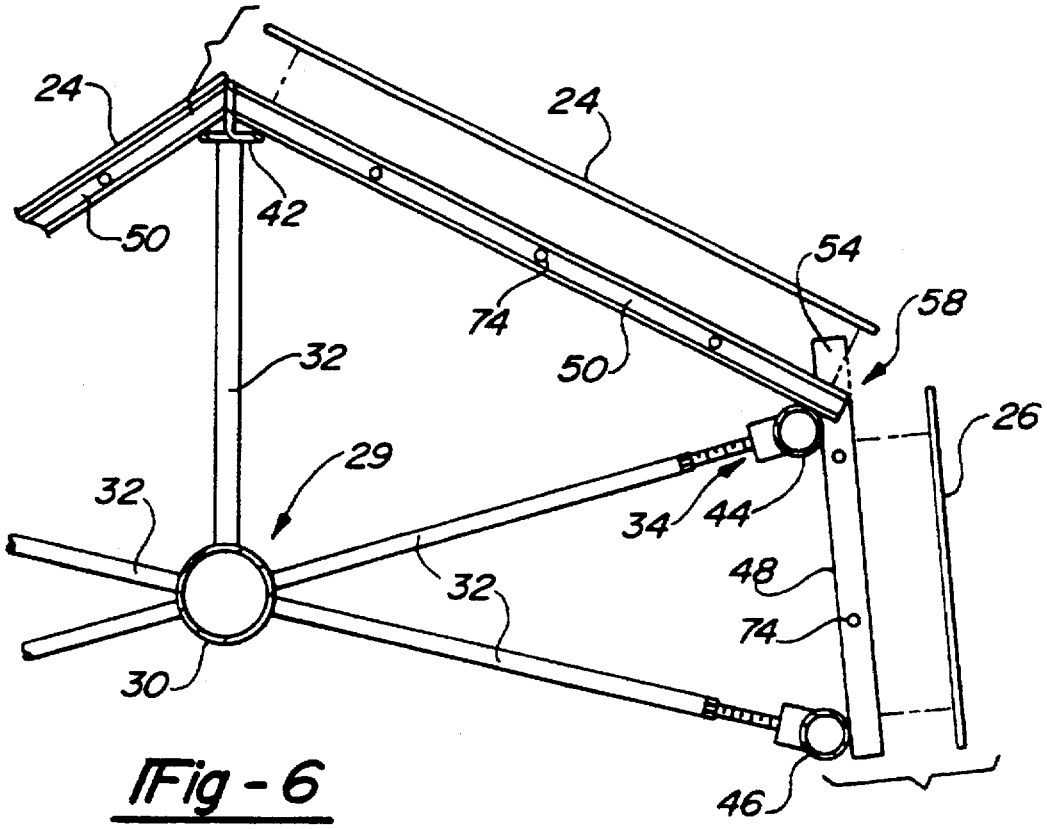
FIG. 6 is a partial cross-sectional view of the embodiment of FIG. 4 taken along the lines 6—6.

FIG. 6 illustrates this portion of the assembly process. An outer skin layer 24, which preferably is made up of a plurality of aluminum sheets or plates, is welded to the frame members 50 and 48, respectively. The method of connection preferably is by stitch welding from the interior of the boat hull 22. The outer skin layer 24 preferably is welded directly to the frame members 50 and 48, respectively. Intersections between the sheets or plates that make up the outer skin layer 24 preferably are connected by a welding joint (as illustrated at 76 in FIG. 8, for example). The sheets or plates that make up the outer skin 24 preferably are made from pieces of aluminum that are as large as practicable, given the particular boat hull configuration. For running surfaces of the boat hull 22, the outer aluminum skin layer preferably is 3/16 inch thick.

After the outer skin layer 24 is secured to the frame members 50 and 48, the support structure 29 preferably is removed from the boat hull. The support structure 29 has now served its purpose of fixing the beams, 42, 44 and 46 in desired locations facilitating the attachment of frame members 48 and 50. The outer skin layer 24 further secures the beams in those positions. As illustrated in phantom in FIG. 5, for example, a conventional cutting tool 56 can be used to sever a portion of the reference support beams 32. The cut preferably is made at the weld joint 56W. Most preferably, the connecting portion 40 is removed from the longitudinal beams 42, 44 and 46. Providing adjustable ends on the support beams 32 also provides the ability to readily reuse the support structure 29 for additional assemblies.

Figure 7:
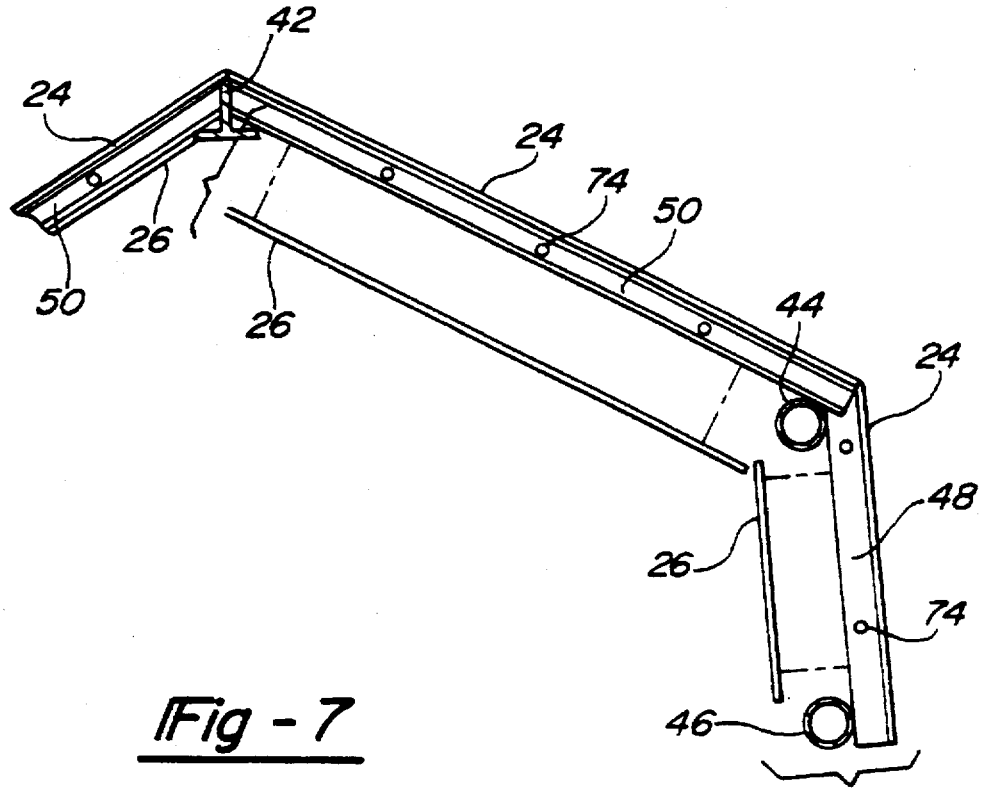
FIG. 7 is an illustration of the embodiment of FIG. 6 during a later portion of the assembly process according to this invention.

After the support structure 29 is removed, the inner aluminum skin layer 26 is welded in place. The inner aluminum skin layer 26 preferably is made of aluminum plates or sheets that are as large as practicable, given the boat hull 22 configuration. By utilizing separate plates or sheets, applicant has also developed a boat hull that can be repaired by simply removing and replacing the particular damaged sheet section in the event that the hull is damaged. The inner skin layer 26 is welded to the frame members 48 and 50 and to the longitudinal beams 42, 44, and 46. Attachment of the inner skin layer 26 by stitch welding is diagrammatically illustrated in FIG. 7.

Figure 8:
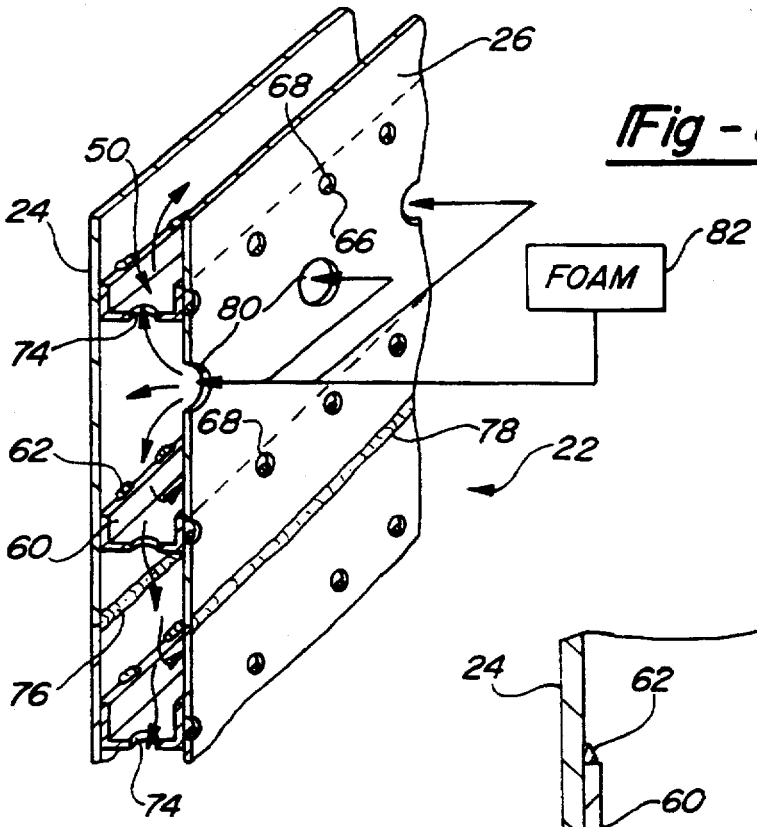
FIG. 8 is a partial cross-sectional view of a partially completed boat hull designed according to this invention.

FIG. 8 illustrates, in cross-sectional view, a portion of the boat hull 22 including the outer skin layer 24, the inner skin layer 26, and frame members 50 sandwiched between the two skin layers.

Figure 9:
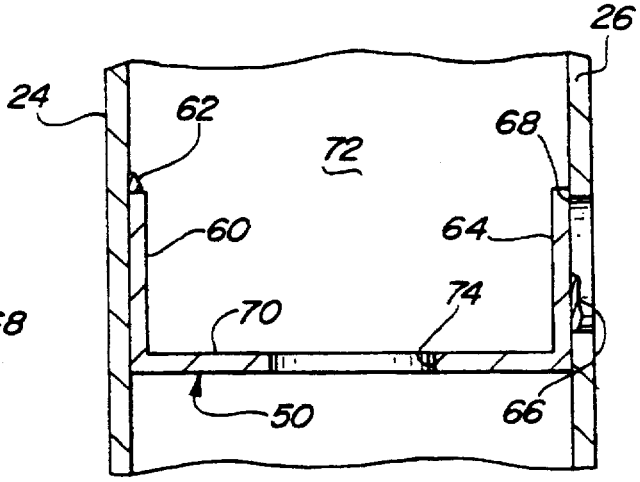
FIG. 9 is a partial cross-sectional view of a selected portion of the embodiment of FIG. 8.

FIG. 9 illustrates, in more detail, the connection between the outer skin layer 24 and an outer arm portion 60 of the frame member 50. The outer skin layer 24 preferably is welded to the frame members from within the boat hull. Stitch weld joints 62 are the most preferred method for connecting the outer skin layer 24 to the outer arm portions 60 on the frame members. (Note that the illustration and description of the frame members 50 applies equally to the frame members 48.) The inner skin layer 26 preferably is welded to an inner arm portion 64 on the frame member 50. Punched holes 68 are provided on the aluminum plates or sheets that make up the inner skin layer 26. Stitch welds 66 are used to connect the inner skin layer 26 to the inner arm portion 64 of the frame member 50 through the holes 68. The frame member 50 includes a web portion 70 extending between the arm portions 60 and 64. The spacing 72 between the outer skin layer 24 and the inner skin layer 26 is defined, in part, by the length of the web portion 70. The frame members 50 and 48 preferably have a square C-shaped cross-section as illustrated. Since the frame members preferably are spaced apart at close intervals, the holes 68 provided on the inner skin layer 26 are spaced apart at the same close intervals.

Figure 10:
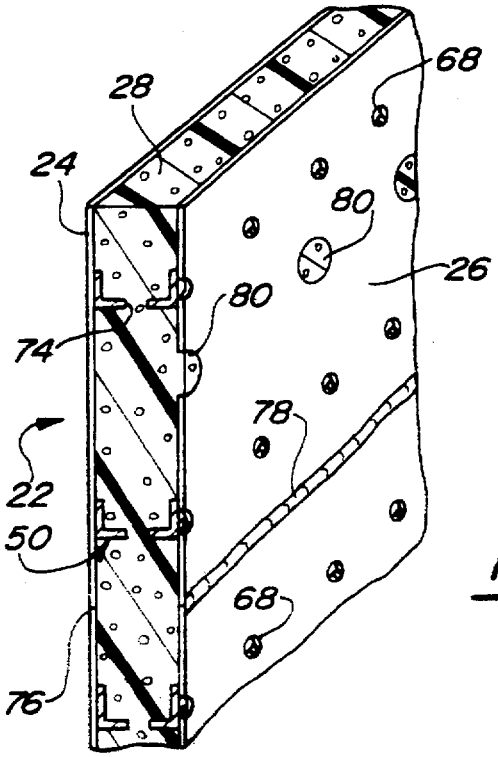
FIG. 10 illustrates the embodiment of FIG. 8 after a foam material has been injected between the aluminum skin layers.

A plurality of holes 74 are provided through the web portions of the frame members. A plurality of prepunched holes 80 are provided on the inner skin layer 26 as illustrated in FIGS. 8 and 9. A conventional source 82 of liquid urethane closed cell foam is used to inject foam through the openings 80 in the inner skin layer 26. The openings 74 in the frame members 50 and 48 allow the liquid foam material to flow through and between the frame members in order to completely fill all spacing between the inner skin layer 26, the outer skin layer 24 and the frame members 48 and 50. The liquid foam will not leak out of the spacing between the inner and outer skin layers because the plurality of plates or sheets that make up each layer are welded with abutting weld joints 78 and 76, respectively. Upon curing, the closed cell foam material 28 completely fills the spacing between the outer skin layer 24, the inner skin layer 26 and the frame members 50 as illustrated in FIG. 10, for example.

The overall wall construction provides increased rigidity. The opposed skins with the cross frame members result in a rigid hull that is able to withstand the stresses and strains that might be incurred by high speed boats. In addition, the foam provides sound deadening, floatation, and even rigidity improvements to the overall construction.

The size of space 72 can be increased to increase the amount of foam 28 such that the boat becomes unsinkable. Moreover, the holes 80 can be sealed, welded or capped after foam filling to increase unsinkability in the event that the outer skin 24 is damaged. The distances between the frame members, the distance between the inner and outer skin layers, and the thicknesses of the skin layers can all be modified to achieve any desired strength. The distance between the skins is controlled by the length of the web portions 70. The length of the web portions preferably varies depending on the length of the boat. For example, when the boat is between twenty and one hundred fifty feet long, the web portions have a length that preferably is between one and six inches.

A boat hull designed and constructed according to this invention is significantly more durable and provides higher performance than previous constructions. The method of constructing the boat hull provides a reliable, economical method for custom designing and building a variety of boat hull configurations while ensuring the integrity of the final product.

The foregoing description is exemplary, rather than limiting in nature. Variations and modifications to the disclosed embodiment will become apparent to those skilled in the art that do not necessarily depart from the spirit and scope of this invention. Therefore, the following claims need to be studied in order to determine the legal scope of this invention.

What is claimed is:

1. A shell for forming portions of a boat hull, comprising:

a plurality of laterally spaced frame members;

a plurality of longitudinal frame pieces connected to said plurality of frame members, said frame members extending between said longitudinal frame pieces in a direction that is generally perpendicular to said longitudinal frame pieces;

an outer skin layer permanently fixed to one side of said frame members;

an inner skin layer permanently fixed to another side of said frame members such that a cavity exists between said inner and said outer skin layers, said frame members being inside said cavity; and a foam material within said cavity, said foam being injected into said cavity as a liquid, each of said frame members having a web portion extending between opposed side walls, said web portion and said side walls extending along a longitudinal length of said frame members, said web portion including a plurality of openings spaced along the longitudinal length of said web portions, said openings in said web portions allowing said liquid foam to pass through said openings such that said foam may fill said cavity.

2. The shell of claim 1, wherein said outer skin layer and said inner skin layer comprise aluminum and are permanently welded to respective sides of said frame members.

3. The shell of claim 2, wherein said skin layers comprise a plurality of aluminum panels having edges that directly abut edges on adjacent panels and wherein said abutting edges are welded together.

4. The shell of claim 1, wherein said inner skin layer is attached to one of said side walls and said outer skin layer is attached to the other of said side walls.

5. The shell of claim 1, wherein each said web portion lies generally within a first plane and said side walls lie generally within a second and third plane, respectively and wherein said first plane is perpendicular to said second and third planes.

6. A shell as recited in claim 1, wherein said longitudinal frame pieces are spaced vertically from each other such that there are upper longitudinal frame pieces defining a vertical uppermost portion of said shell, said skin layers extending vertically downwardly from said vertically uppermost longitudinal frame piece towards lower ones of said frame pieces to define sides of said shell, and said foam extending into the cavity upwardly towards said vertically uppermost of said longitudinal frame pieces.

7. A method of assembling a shell for use in constructing a boat hull, comprising the steps of:

(A) arranging a plurality of support pieces in a preselected orientation;

(B) attaching a plurality of longitudinal beams to the support pieces;

(C) attaching a plurality of spaced frame members to the longitudinal beams so that the frame members extend between the longitudinal beams;

(D) attaching a first skin layer to an outer portion of the frame members;

(E) disconnecting the support pieces from the longitudinal beams; and (F) then attaching a second skin layer to an inner portion of the frame members to enclose the frame members between said first and second skin layers, and to the longitudinal beams.

8. The method of claim 7, further comprising the step of (G) filling spacing between the first and second skin layers with a foam material.

9. The method of claim 8, wherein step (G) is performed by injecting a liquid curable foam material into the spacing between the skin layers through an opening in one of the skin layers.

10. The method of claim 9, wherein step (G) is performed by allowing the liquid foam material to flow through predefined openings in the frame members.

11. The method of claim 7, wherein step (A) is performed by connecting a plurality of outwardly extending support pieces to a central support piece wherein the outwardly extending support pieces have a selected orientation and selected lengths such that outward ends on said support pieces define a shape of a boat hull and wherein step (B) is performed by manipulating the longitudinal beams to correspond to the shape defined by the outward ends on the extending support pieces and welding the longitudinal beams to the extending support pieces.

12. A method as recited in claim 11, wherein the outward ends are threadably attached to inner portions of said support pieces, and said outward ends may be threadably adjusted to reach said selected orientation prior to attaching the longitudinal beams to the outward ends.

13. The method of claim 7, wherein the frame members and the first and second skin layers are made from a metal and wherein step (D) is performed by welding the first layer to the outer portion of the frame members and step (F) is performed by welding the second skin layer to the inner portion of the frame members.

14. A method of assembling a shell for use in constructing a boat hull comprising the steps of:

(A) arranging a plurality of support pieces extending outwardly of a central support piece wherein the outwardly extending support pieces have a selected orientation and selected lengths, and such that outward ends of said support pieces define a shape of a boat hull;

(B) attaching a plurality of longitudinal beams to the support pieces, said longitudinal beams being manipulated to correspond to the shape defined by the outward ends of the extending support pieces and securing the longitudinal beams to the extending support pieces at their outer ends;

(C) attaching a plurality of spaced frame members to the longitudinal beams so that the frame members extend between the longitudinal beams;

(D) attaching a first skin layer to an outer portion of the frame members;

(E) disconnecting the support pieces from the longitudinal beams; and (F) attaching a second skin to an inner portion of the frame members and to the longitudinal beams.

15. A method as recited in claim 14, wherein said longitudinal beams are attached to the outward ends by welding.

* * * * *